United States Patent [19]

Starr

[11] 4,149,637

[45] Apr. 17, 1979

[54] APPARATUS FOR SIZE-GRADING OBJECTS

[75] Inventor: John H. Starr, Hustisford, Wis.

[73] Assignee: Starr, Incorporated, Hustisford, Wis.

[21] Appl. No.: 867,344

[22] Filed: Jan. 5, 1978

[51] Int. Cl.[2] ..... B07C 5/06; B07B 1/18

[52] U.S. Cl. ..... 209/621; 209/664; 209/668; 209/285

[58] Field of Search ..... 209/621, 632, 659, 660, 209/664, 666, 667, 668, 674, 680, 683, 684, 686, 933, 284, 285, 288–291, 687

[56] References Cited

U.S. PATENT DOCUMENTS

| | | | |
|---|---|---|---|
| 1,118,834 | 11/1914 | Woods | 209/621 |
| 1,196,975 | 9/1916 | Pease | 209/621 |
| 2,207,131 | 7/1940 | Pellam | 209/621 |
| 2,687,212 | 8/1954 | Kerr et al. | 209/664 X |
| 3,259,241 | 7/1966 | Hughes | 209/690 |
| 3,269,533 | 8/1966 | Sandmeyer | 209/621 |

*Primary Examiner*—Joseph J. Rolla
*Assistant Examiner*—Edward M. Wacyra
*Attorney, Agent, or Firm*—James E. Nilles

[57] ABSTRACT

Apparatus for size-grading elongated objects of differing diameters, such as green beans or the like, comprises concentrically arranged inner and outer hollow rotatable slotted drums, with the outer drum having a greater number of axially extending circumferentially spaced apart slots therein than the inner drum; drive mechanisms for rotating both drums in the same direction but at different relative speeds, whereby the slots in the inner and outer drums overlap in different relationships and cooperate so as to define entry slots of different widths at different peripheral positions around the outer drum; an object feeding chute outside the outer drum for directing objects to be size-graded to an entry slot of desired width; a conveyor within the inner drum for receiving size-graded objects which have fallen through the selected entry slot, and a collector on the outside of the outer drum for collecting those objects which have not fallen through the selected entry slot. An adjustable mechanism to rotatably shift the inner drum with respect to the outer drum enables relocation of the entry slot of desired width relative to the object feeding chute. The apparatus is further adapted to length-grade the objects by the addition of axially spaced apart rods along the slots in the inner drum.

15 Claims, 6 Drawing Figures

APPARATUS FOR SIZE-GRADING OBJECTS

BACKGROUND OF THE INVENTION

Field of Use

This invention relates generally to apparatus for size-grading elongated objects of differing diameters and lengths, such as green beans, raw french fried potatoes, or the like. In particular, it relates to such apparatus which employs concentrically arranged, relatively rotatable hollow slotted drums.

Description of the Prior Art

The prior art discloses many types of apparatus or machines for size-grading various kinds of objects such as fruit, vegetables, large granular substances, small mechanical parts, and so forth, which employ one or more rotatable drums. The following U.S. Pat. Nos. evidence the state of the art: 2,065,557; 2,086,408; 2,462,682; 2,523,055; 2,858,019; 2,984,351; 3,200,945; 3,241,667; 3,259,241; 3,389,788; 3,389,791; 3,827,554.

SUMMARY OF THE PRESENT INVENTION

In accordance with the present invention, an apparatus for size-grading elongated objects of differing diameters and lengths, such as green beans or the like, comprises concentrically arranged inner and outer hollow rotatable drums, with the outer drum having a different (greater) number of axially extending circumferentially spaced apart slots therein than the inner drum; drive means for rotating both drums in the same direction but at different relative speeds, whereby the slots in the inner and outer drums overlap in different relationships and cooperate so as to define entry slots of different widths at different peripheral positions around the outer drum; means including an object feeding chute outside the outer drum for directing objects to be size-graded to an entry slot of desired width; a conveyor within the inner drum for receiving size-graded objects which have fallen through the selected entry slot; and a collector on the outside of the outer drum for collecting those objects which have not fallen through the selected entry slot. Adjustable means to rotatably shift the inner drum with respect to the outer drum enable relocation of the entry slot of desired width relative to the object feeding chute. The apparatus is further adapted to length-grade the objects by the addition of axially spaced apart rods along the slots in the inner drum. In use, rotation speed is between 10 and 35 rpm.

In the embodiment of the invention disclosed herein, the outer drum has a greater number of slots than the inner drum (such as 31 slots compared to 30 slots), and the inner drum rotates slightly faster than the outer drum (such as 1.033 times as fast). The slots in each individual drum are of equal width but the slots in the inner drum are narrower than the slots in the outer drum. As a result, at two diametrically opposite positions at the periphery of the outer drum, there will be an entry slot of greatest width at one position and no entry slot whatsoever at the other position. However, the entry slots between these two positions will be of decreasing size, proceeding from the widest entry slot. The drive means for rotating the drums includes a mechanism for adjustably advancing or retarding the position of the inner drum relative to the outer drum so as to enable an entry slot of desired width to be located at the peripheral position whereat it is in association with the object feeding chute means for directing objects into the drum. Each slot in the outer drum is defined by a pair of outer drum bars and each outer drum bar is of triangular cross section and constructed so that objects, which are unable because of their size to fall into the entry slot which is located near the upper periphery on one side of the outer drum, are carried around on the exterior of the outer drum and dropped off on the opposite side of the drum into a collector from which they are removed for further processing. In the embodiment disclosed, the conveyor within the inner drum takes the form of a belt conveyor almost as wide as the inner drum diameter and movable along the drum axis from one end of the drum and out the other. The apparatus is enclosed within a suitable housing or enclosure which has an inlet opening for the object feeding chute and an outlet opening for the collector. In one embodiment, axially spaced apart rods are attached to the inner bars on the inner drum to divide the spaced apart slots of the inner drum and thereby enable the apparatus to length-grade as well as diameter-grade the objects.

Apparatus in accordance with the invention offers several advantages over the prior art. For example, instead of conveying the objects to be graded to the inside of a drum from whence they fall outward of the drum during size grading, as in the case in many types of prior art size graders, the objects to be graded by apparatus in accordance with the invention are directed to the outside of the drum from whence they fall inside the drum during grading. The advantage of this arrangement results in the availability of increased amount of grading surface and thereby enables a faster or higher volume grading operation. Furthermore, the use of drums having axially extending slots gives a working area which is longer and thereby enables many different sizes and shapes of objects to be sorted. Apparatus in accordance with the invention not only enables objects to be graded according to their diameter but, by means of the rod attachments, enables the same objects to be length graded also. The mechanism for advancing and retarding the inner drum can be actuated to carry out a size adjustment while the apparatus is in operation simply by turning a crank. Thus, it is not necessary to stop the machine to make a size adjustment, and costly downtime is eliminated. Apparatus in accordance with the invention is relatively easy and economical to construct and uses many conventional components and sub-assemblies. Furthermore, the apparatus is reliable in use, accurate in its grading, easy to readjust during operation, and is safe in operation. Other objects and advantages of the invention will hereinafter appear.

DESCRIPTION OF THE PREFERRED EMBODIMENT

Figure 1:
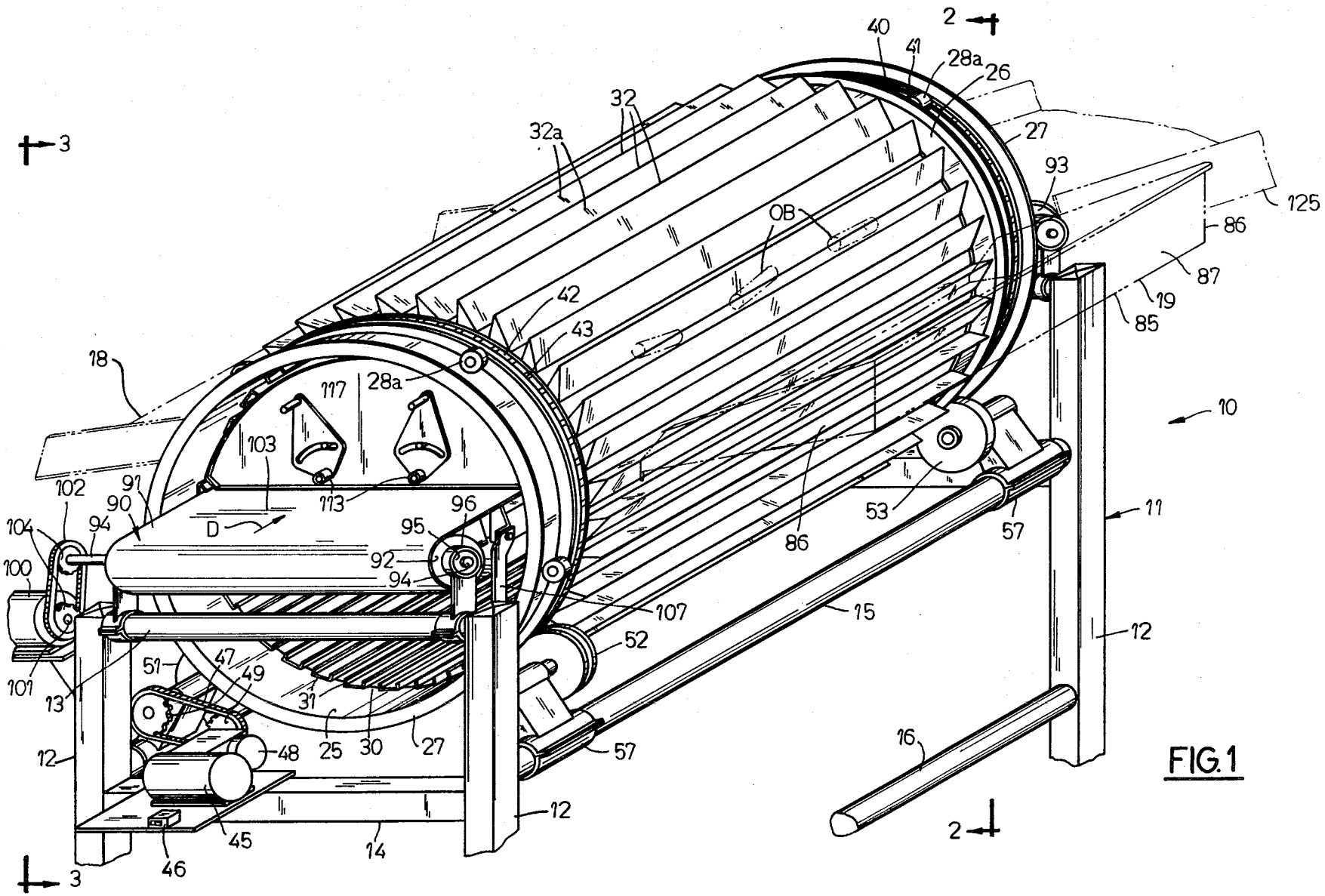
FIG. 1 is a perspective view of apparatus for size-grading objects in accordance with the invention.
Figure 2:
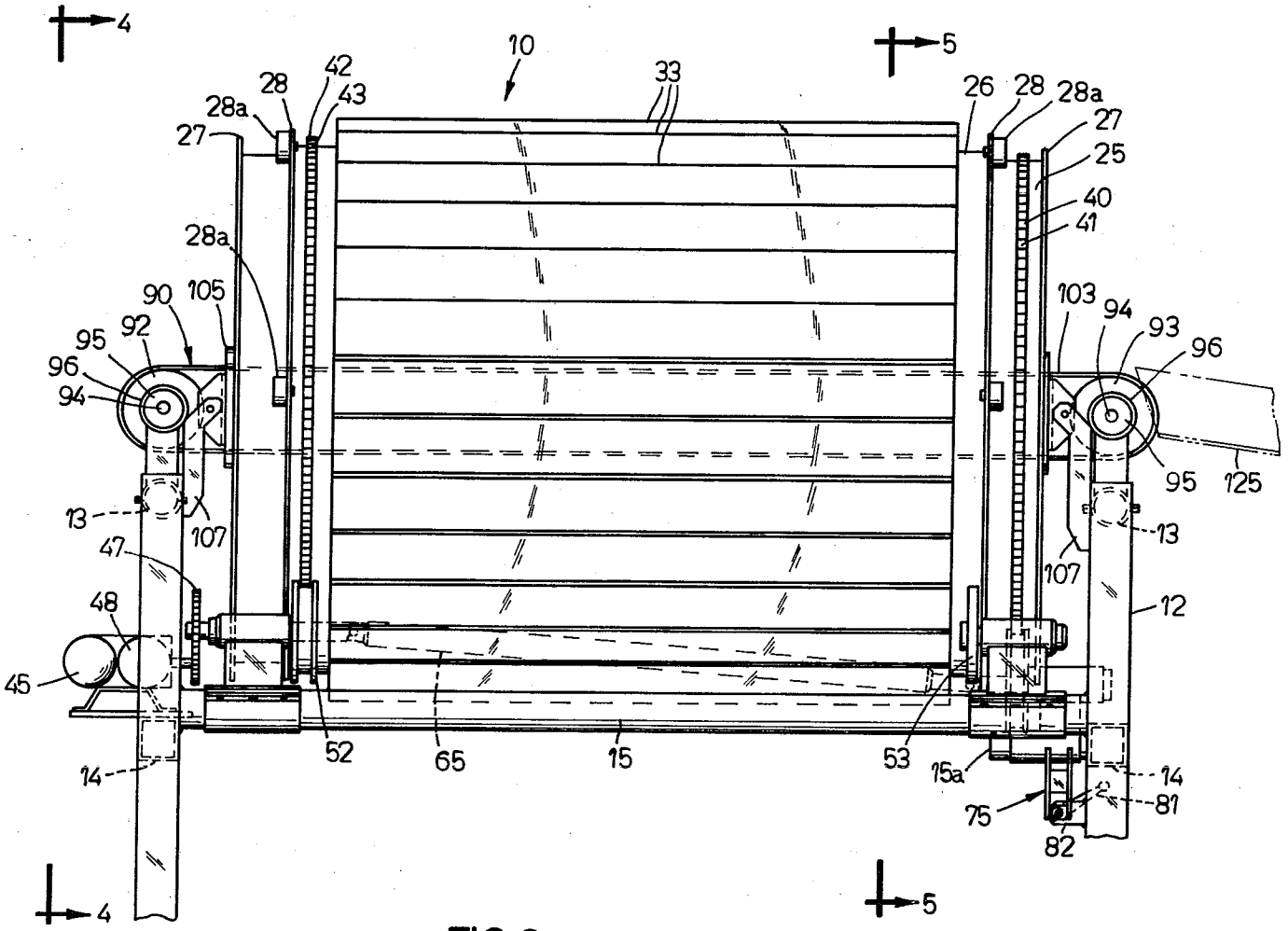
FIG. 2 is a side elevational view of the intake side of the apparatus shown in FIG. 1 taken on line 2—2 of FIG. 1.
Figure 3:
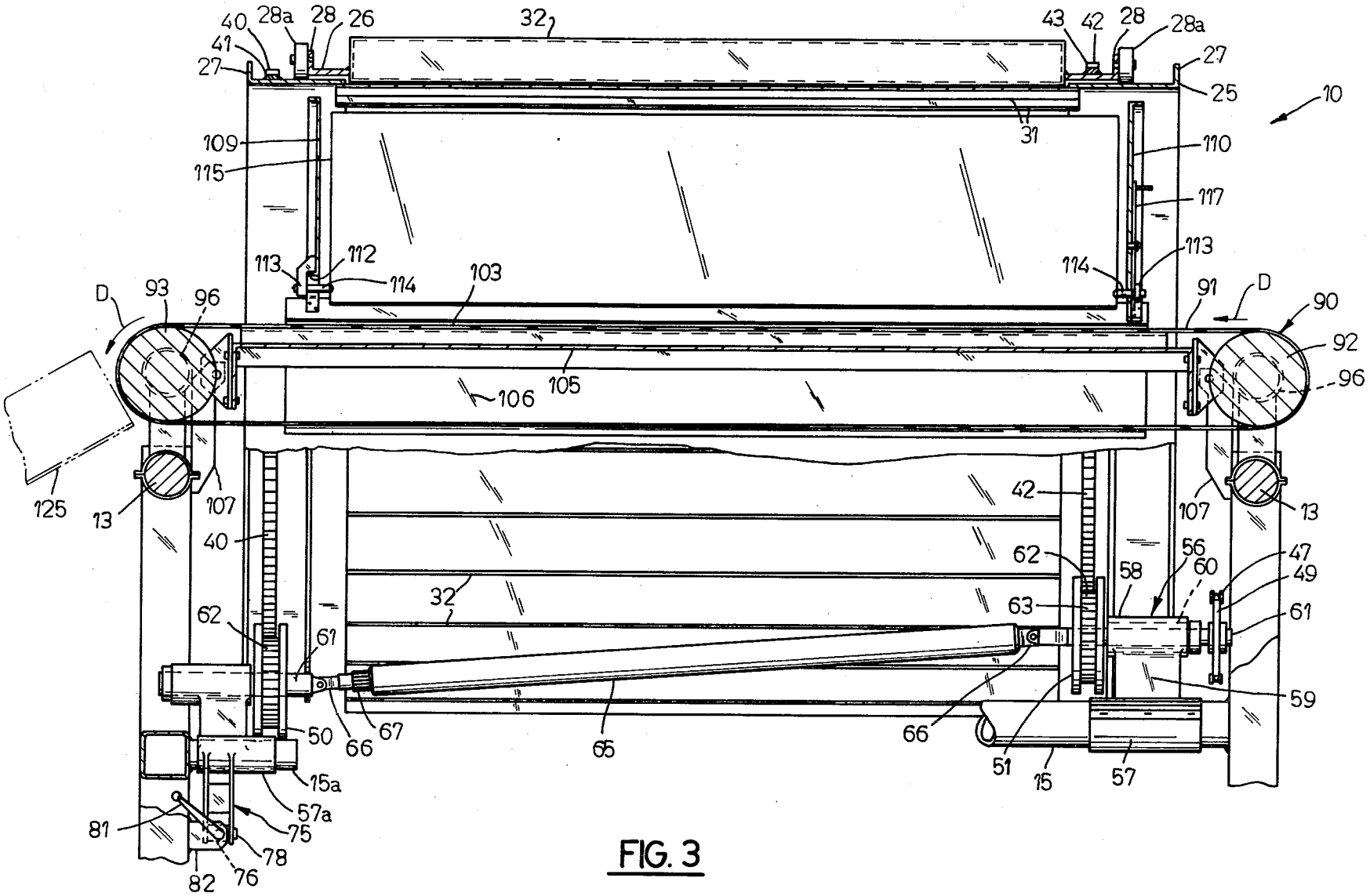
FIG. 3 is a side elevational view, partially in cross section, of the opposite side of the apparatus taken on line 3—3 of FIG. 1.
Figure 5:
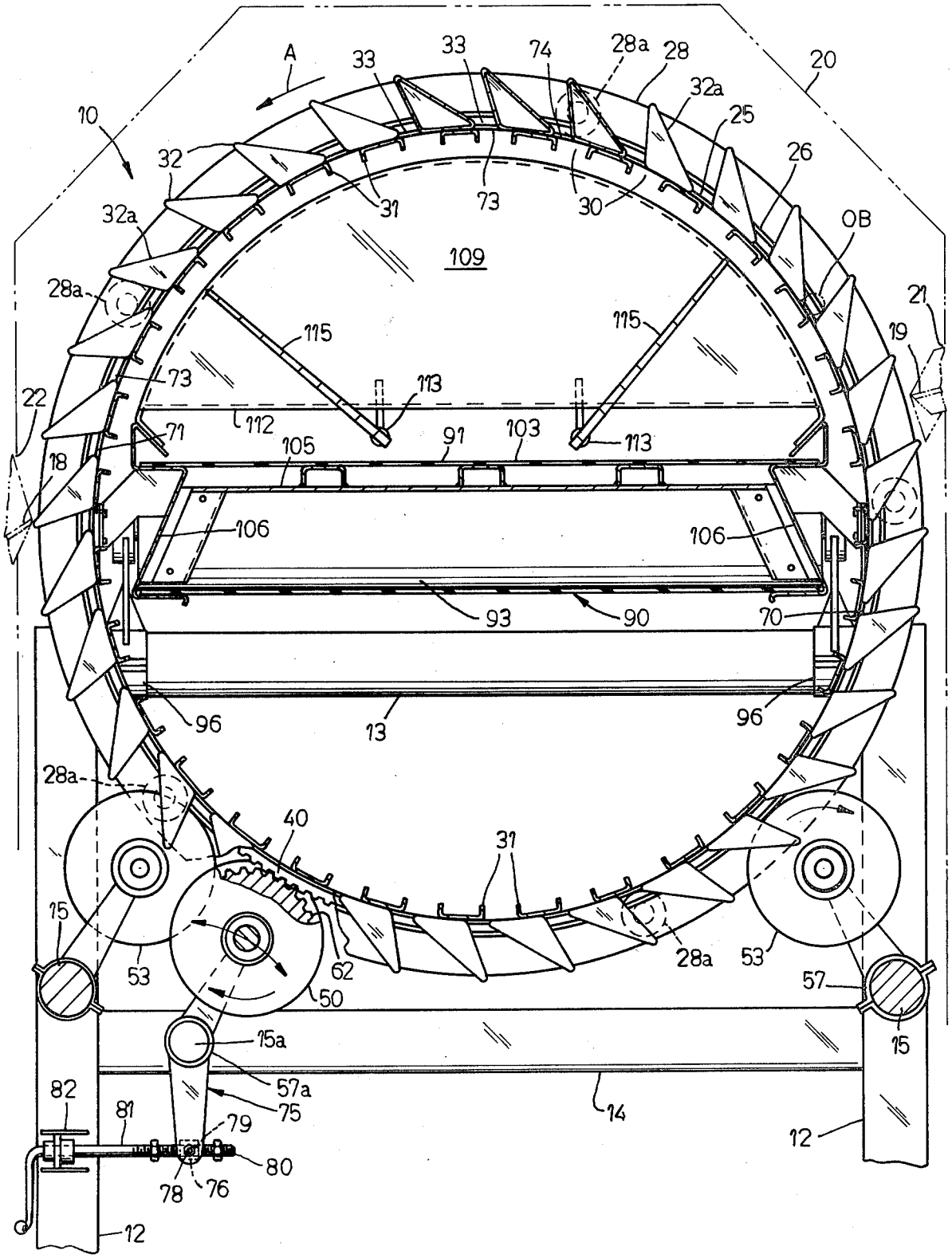
FIG. 5 is a cross-sectional view taken on line 5—5 of FIG. 2 and shows the relationship between the slots in the inner and outer drums.

Referring to FIGS. 1, 2, and 3 of the drawings, the numeral 10 designates apparatus in accordance with the invention for size-grading elongated objects OB of differing diameters, such as green beans, french-fries, or the like. Apparatus 10 comprises a supporting structure or frame 11 which includes, for example, four vertical legs 12 which are interconnected by upper and lower end cross braces 13 and 14, respectively, and by upper and lower side cross braces 15 and 16, respectively. Apparatus 10 comprises a sheet metal hood 20 which is shown in FIG. 5, but for purposes of clarity has been removed from all other figures. Hood 20 has an inlet opening or port 21 for receiving objects to be graded from a chute 19 and an outlet port or opening 22 for discharging oversized objects into a collector 18. Apparatus 10 comprises concentrically arranged inner and outer hollow rotatable slotted drums 25 and 26, respectively. Inner drum 25 comprises axially spaced apart end rings 27 which rigidly support a plurality of axially extending circumferentially spaced apart inner bars 31 of U-shaped cross section which define axially extending circumferentially spaced apart inner slots 30. In the embodiment shown, inner drum 25 has 31 (thirty-one) inner bars 31 and 31 (thirty-one) inner slots 30. Outer drum 26 comprises axially spaced apart end rings 28 which rigidly support a plurality of axially extending circumferentially spaced apart outer bars 32 of triangular-shaped cross section which define axially extending circumferentially spaced apart outer slots 33. In the embodiment shown, outer drum 26 has 32 (thirty-two) outer bars 32 and 32 (thirty-two) outer slots 33. Each bar 32 includes a surface 32*a* which, as FIG. 5 shows, passes through the horizontal position to a downwardly sloped position as the drum 26 rotates. Relative spacing between drums 25 and 26 as they rotate is maintained by rollers 28*a* which are rotatably mounted on outer end rings or flanges 28 of outer drum 26 and ride against end rings or flanges 27 of inner drum 25.

Inner drum 25 is provided with a ring gear 40 at one end which has 155 teeth, or, one inner bar 31 at every fifth gear tooth 41. Outer drum 26 is provided with a ring gear 42 at one end which has 160 teeth, or, one outer bar 32 at every fifth gear tooth 43.

Drive means are provided for rotating both drums 25 and 26 in the same direction (in the direction of arrow A in FIG. 5) but at different relative speeds. The drive means comprise an electric motor 45 energizable from a suitable electric power source (not shown) by means of an on-off switch 46, as FIG. 1 shows. Variable speed electric motor 45 is connected to a reduction gear unit 48 and the output shaft of the latter is connected by a drive chain 47 and a pair of sprockets 49 to drive a pair of driven travelers 50 and 51 which, in turn, drive the inner and outer drums 25 and 26, respectively. An idler traveler 52 is provided for inner drum 25. A pair of idler travelers 53 for the outer drum 26 is also provided. Each of the four travelers 51, 52 and 53 is mounted at one end of a cross bar 15. The four travelers 51, 52, and 53 are rigidly secured to their respective cross bars 15 and the driven traveler 50 is movably mounted on a stub shaft 15*a*, as hereinafter described, to effect a phase shift of the drums 25 and 26 to move an entry slot of desired width to a desired location. Since the five travelers 50, 51, 52, and 53 are generally similar in construction and mode of operation, except that 50 and 51 include gears 63 and 62, respectively, a description of driven traveler 51 will suffice as regards common elements. Traveler 51 comprises a support bracket 56 which includes a lower tubular member 57 mounted on cross bar 15, an upper tubular member 58 which is rigidly secured in spaced relationship to lower tubular member 57 by a bracket 59. Upper tubular member 58 carries an anti-friction bearing sleeve 60 therein in which a shaft 61 is rotatably mounted. A gear 62 having 26 teeth 63 is secured to shaft 61 for rotation therewith. The two gears 62 for the idlers 50 and 51 are in constant mesh with their respective ring gears 40 and 42 on the drums 25 and 26, respectively. The gears 62 on the driven travelers 50 and 51 are driven gears and effect rotation of the drums 25 and 26, respectively, in the same direction (arrow A in FIG. 5) but at different relative speeds. The three idler travelers 52 and 53 are provided to afford support for the drums 25 and 26. One end of shaft 61 of the driven travel 51 is connected to one of the sprockets 49 associated with the reduction gear unit 48. The shafts 61 of the driven travelers 50 and 51 are interconnected with each other by means of a drive shaft 65. The drive shaft 65 is provided at each end thereof with a universal joint 66 and a spline connector 67, and the spline connector is secured to an end of each of the shafts 61 of the idlers 50 and 51.

The hereinbefore described drive means cause both drums to rotate in the same direction but at different relative speeds. As a result, the inner slots 30 in the inner drum 25 and the outer slots 33 in the outer drum 26 will overlap in different relationships and cooperate so as to define a plurality of entry slots of different widths, such as 73 and 74 in FIG. 5, at different peripheral positions around the outer drum 26. For example, as FIG. 5 shows, there are thirty-one inner bars 31, one at every fifth gear tooth 41 of the inner drum 25 and there are thirty-two outer bars 32, one at every fifth gear tooth 43 of the outer drum 26. Furthermore, since each traveler gear 62 has 26 teeth 63, and since the inner ring gear 40 has 155 teeth and the outer ring gear 42 has 160 teeth, the thirty-one inner slots 30 and the thirty-two outer slots 33 will overlap in such a way when the drums are rotated that at 0° point in FIG. 5, there will be no entry slot, as numeral 70 indicates, and at the 180° point, which is 180° around the periphery of the outer drum 26 from point 70 in FIG. 5, there will be an entry slot 71 of maximum width. The entry slots, such as 74 and 73, between the slots 70 and 71 will each be of proportionately larger width relative to one another. An object OB can fall through any entry slot 73, 74 of greater width than the diameter of the object.

Figure 4:
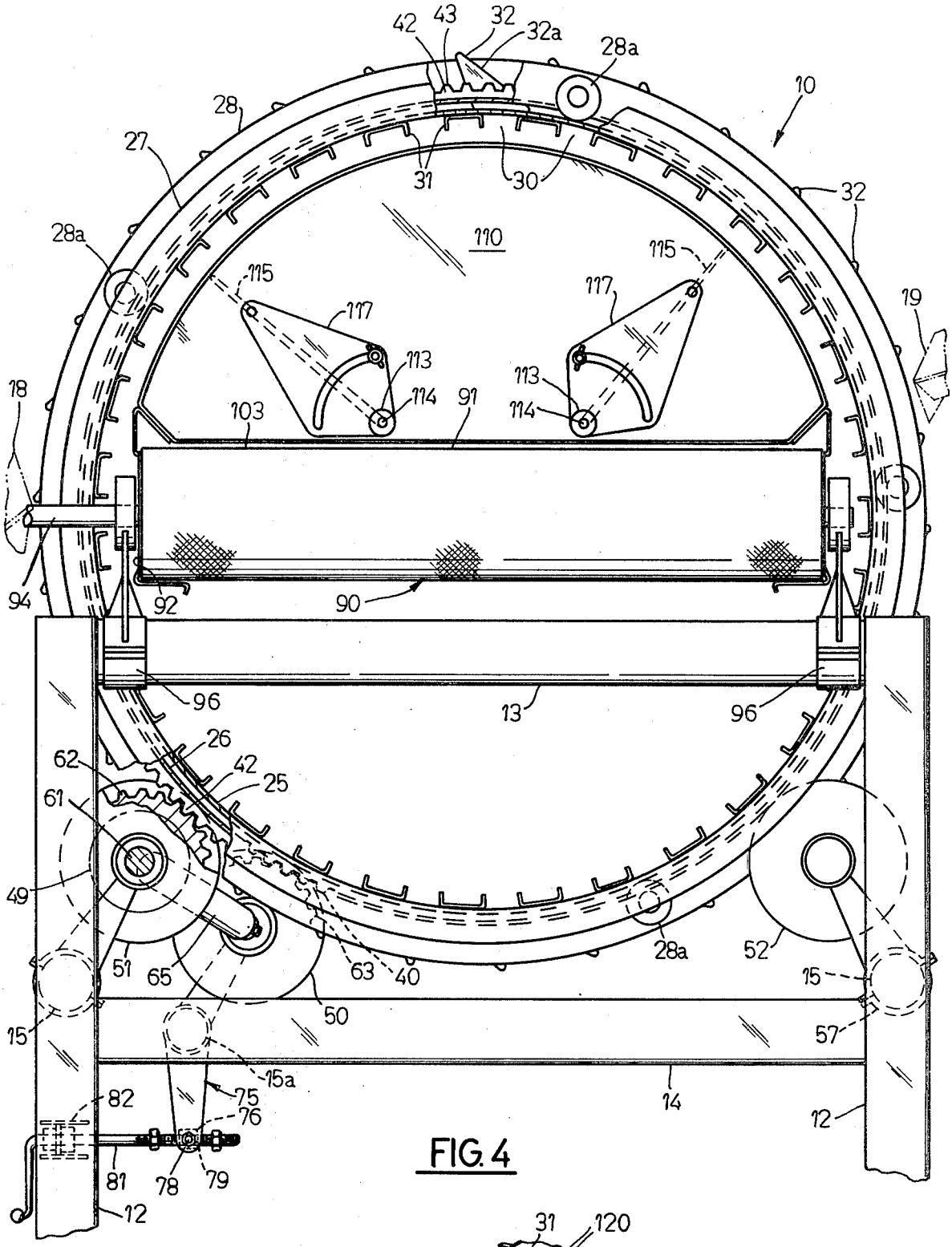
FIG. 4 is an end elevational view of the apparatus shown in FIGS. 1, 2, and 3 taken on line 4—4 of FIG. 2.

As FIG. 4 shows, an adjustment mechanism is provided for the adjustably movable driven traveler 50 and includes a lower tubular member or sleeve 57A which is rotatably mounted on the stub shaft 15*a*. A bracket assembly 75 extends downwardly from the sleeve 57A and carries a block 76 which is pivotally mounted on the bracket 75 by means of a pin 78. The block 76 is provided with a threaded opening 79 extending therethrough for threaded engagement with the threaded end portion 80 of a crank 81 which is rotatably mounted on stub shaft 15*a*by means of a crank support member 82 mounted on one of the vertical legs 12. Rotation of crank 81 in either direction causes the adjustable driven traveler 50 to be pivotally movable to a limited degree in the selected direction around its stub shaft 15*a*. As will be understood, the drive shaft 65 with its universal joints 66 permits such limited relative movement. As such relative movement occurs, the teeth 63 of the driven traveler gear 62 engage the teeth of ring gear 40 on inner drum 25 and cause the inner drum 25 to rotate axially to a slightly different position in the selected direction relative to the outer drum 26. The purpose and result of this relative re-positioning of the inner drum with respect to the outer drum is to cause a phase shift, so to speak, whereby the entry slot 71 of maximum width is shifted to a different position relative to the exterior of outer drum 26. As a result of such movement, an entry slot 73, 74 of the desired width can be positioned relative to the inlet port 21 for the discharge end of the chute 19 outside the outer drum 26 which directs objects to be size-graded to the entry port.

The chute 19 is located exteriorly of the outer drum 26 and is constructed and mounted on the housing 20 in such a position as to enable objects entering inlet port 21 of housing 20 to be gravity fed by the chute 19 to the outer slots 33 for subsequent entry into the selected entry slot 73 or 74 of greater diameter. Chute 19 comprises a downwardly sloped bottom plate 85, two upwardly extending side plates 86, and an upper end plate 87 and is open at its lower end. The chute 19 is substantially as wide as the entry slots are long.

As FIGS. 1, 2, 3, 4, and 5 show, a conveyor 90 is disposed within the inner drum 25 for receiving size-graded objects which have fallen through the entry slots which are wider than a selected entry slot 73, 74. However, objects resting on surface 32*a* of a bar 32 which is horizontal or downwardly sloped will be discharged into chute 18 as drum 26 rotates. Conveyor 90 comprises a flat flexible endless belt 91 which is supported at opposite ends by a driven roller 92 and an idler roller 93. Each of the rollers 92 and 93 is provided with a shaft 94 and the ends of the shaft are journalled for rotation in bearings 95 which are mounted on bearing supports 96. Each bearing support 96 is rigidly connected to a support bar 13 of frame 11 at an end of the apparatus 10. Driven roller 92 is driven by means of an electric motor 100, shown in FIG. 1, having a shaft 101 which is connected by a drive chain 102 and sprockets 104 to the shaft 94 of driven roller 92. Conveyor belt 91 is driven so that the upper surface 103 thereof moves in the direction of arrow D shown in FIGS. 1 and 3. The conveyor 90 is constructed and located so that the width of the upper surface 103 of the conveyor belt 91 is substantially the same as the largest inner diameter of the inner drum 25, thereby providing an object-receiving surface 103 on belt 91 which has a large carrying capacity. Conveyor 90 discharges into a packing carton or another conveyor 125, shown in FIG. 3.

Means are provided within the inner drum 25 and in association with the upper surface 103 of conveyor belt 91 to direct size-graded objects falling into the inner drum 25 onto the conveyor 90 and to prevent the objects from falling off the conveyor within the drum. Such means comprise a lower plate 105 which extends beneath and physically supports the upper side of the conveyor belt 91 and which has upwardly extending side walls 106. The plate 105 is supported by means of brackets 107 which are rigidly secured to the support structure 11. End plates 109 and 110 are provided near the discharge end and the opposite end of the conveyor 90. The plates 109 and 110 are rigidly connected to and supported on the lower plate 105. As FIGS. 3 and 5 show, the bottom edge 112 of end plate 109 is spaced sufficiently far above the discharge end of the upper surface 103 of the conveyor belt 91 so as to permit objects to be conveyed therepast without interference. A pair of spaced apart side guide plates 115 extend between the end plates 109 and 110. Each end plate 109 and 110 is provided with a pair of spaced apart bushings 113. A rod 114 on each end of each end guide plate 115 extends between the guide plate 115 and each bushing 113, which rotatably supports the rod 114. As FIGS. 1, 3, and 4 show, two of the rods 114 are provided with a manually operable lever 117 which enables the associated guide plate 115 to be angularly adjusted. The pair of guide plates 115 cooperate with each other to define a channel for directing and confining size-graded objects onto the belt 91 of the conveyor 90.

Figure 6:
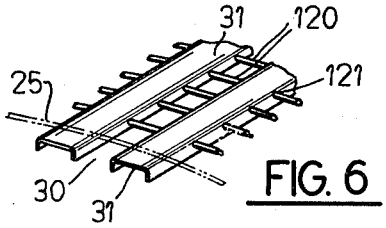
FIG. 6 is a perspective view of a portion of a grill used in an alternative embodiment for size-grading objects with respect to length.

The apparatus 10 as thus far described, is capable of size grading elongated objects of differing diameters. Apparatus 10 can be further adapted to enable simultaneous length grading of such elongated objects by providing axially spaced apart rods 120 along and interconnected between the inner bars 31 of inner drum 25 as shown in FIG. 6. The difference is spacing between adjacent pairs of rods 120 determines the length of the object which is able to pass therethrough. In FIG. 6, the rods 120 are shown as extending through holes 121 in the inner bars 31 and bridging the inner slots 30. However, the bars 120 could, for example, be secured to the ends of the legs of the U-shaped bars 31 or could be secured in some other suitable manner.

Operation

The apparatus 10 operates in the following manner. Assume that the crank 81 of the adjustment mechanism has been operated so as to locate an entry slot 73 of desired width adjacent inlet port 21 of hood 20 and the discharge end of the chute 19. Further assume that the electric motors 45 and 100 are energized and that the conveyor 90 is in operation, moving in the direction of arrow D, and that both drums 25 and 26 are in operation and rotating in the direction of arrow A. As will be understood, the entry slot 73 of desired width will always occur at the same position relative to trough 19 (but counterclockwise therefrom in FIG. 5), unless the adjustment mechanism is operated to cause a phase shift resulting in an entry slot of a different width appearing at that position. Also assume that the guide plates 115 have been adjusted to the desired position relative to the entry slots which are in use. Under these conditions, assume that objects are being deposited through inlet 21 of housing 20 from the chute 19 and are being directed against the exterior of the rotating outer drum 26. As this occurs, the objects fall randomly into the slots 33 between the triangular outer bars 32 of the outer drum 26. Although as FIG. 5 shows, the diameter of an object OB is smaller than the width of an outer slot 33, the object cannot fall through the outer slot into an underlying inner slot 30, even though the inner slot 30 is wider than the diameter of the object, until two slots 33 and 30 register and define an entry slot 73 which is of greater width than the diameter of the object. Objects of the desired size will, therefore, fall through the selected entry slots 73, whereas any object of larger diameter will be transported by the surface 32*a* of an outer bar 32 upward over and down the other side of the outer rotating drum 26 (which rotates counterclockwise in FIGS. 1, 4, and 5), from whence it will fall into the collector 18 for the ungraded objects. Those objects of desired size which are able to fall through the desired entry slots are directed between the guide plates 115 and fall onto the upper surface 103 of conveyor belt 91 and are carried thereby out of the inner drum and deposited into a suitable receptacle such as a packing carton, or another conveyor 125. This grading process is repeated for each object falling onto the exterior of the outer drum 26. Since each entry slot 73 is relatively long, it can accommodate or receive several objects at one time.

As FIG. 6 shows, if the rods 120 are employed, then an object OB, even if it is of the proper diameter for passage through an entry slot 73, cannot pass through a space between adjacent rods 120 unless it is shorter than the latter space. Thus, when the rods 120 are employed in assembly 10, the objects are not only size-graded with respect to diameter but are also size-graded with respect to length.

I claim:

1. Apparatus for size-grading objects comprising:

concentrically arranged inner and outer hollow rotatable drums, each of said drums having different numbers of axially extending circumferentially spaced apart slots therein;

drive means for rotating both of said drums at different speeds whereby the slots in said inner and outer drums overlap in different relationships and cooperate so as to define entry slots of different widths at different peripheral positions around said outer drum;

means outside said outer drum for directing objects to be size graded to an entry slot;

and means within said inner drum for receiving size-graded objects which have fallen through an entry slot of desired width and for discharging said size-graded objects from said inner drum.

2. Apparatus according to claim 1 wherein said drive means rotates said drums in the same direction.

3. Apparatus according to claim 2 wherein said outer drum has a greater number of slots than said inner drum and wherein said inner drum rotates at a faster speed than said outer drum.

4. Apparatus according to claim 3 wherein said outer drum has an even number of slots and said inner drum has an odd number of slots.

5. Apparatus according to claim 4 wherein said outer drum has only one more slot than said inner drum.

6. Apparatus according to claim 1 including means to rotate one of said drums to a different axial position relative to the other to thereby cause a circumferential shift in the position of said entry slots.

7. Apparatus according to claim 1 including means on at least one of said drums for dividing each slot lengthwise to also effect lengthwise size-grading of objects.

8. Apparatus according to claim 1 wherein said means within said inner drum comprises a linearly movable conveyor.

9. Apparatus for size-grading objects comprising:

concentrically arranged inner and outer hollow rotatable drums, each of said drums having different numbers of axially extending circumferentially spaced apart slots therein;

drive means for rotating both of said drums in the same direction but at different speeds whereby the slots in said inner and outer drums overlap in different relationships and cooperate so as to define entry slots of different widths at different peripheral positions around said outer drum, said drive means including a first ring gear connected to said inner drum, a second ring gear connected to said outer drum, said first and second ring gears having different numbers of teeth, a drive shaft having first and second drive gears thereon which mesh with said first and second ring gears, respectively, said first and second drive gears having the same number of teeth thereon;

means outside said outer drum for directing objects to be size-graded to an entry slot;

and means within said inner drum for receiving size-graded objects which have fallen through an entry slot of desired width and for discharging said size-graded objects from said inner drum.

10. Apparatus according to claim 9 including adjustment means to rotate one of said drums to a different axial position relative to the other to thereby cause a circumferential shift in the position of said entry slots, said adjustment means including means to move said first drive gear to a different circumferential position with respect to said first ring gear with which it meshes.

11. Apparatus according to claim 9 wherein said outer drum has a greater number of slots than said inner drum and wherein said inner drum rotates at a faster speed than said outer drum.

12. Apparatus according to claim 11 wherein said outer drum has an even number of slots and said inner drum has an odd number of slots.

13. Apparatus according to claim 12 wherein said outer drum has only one more slot than said inner drum.

14. Apparatus according to claim 9 including means on at least one of said drums for dividing each slot lengthwise to also effect lengthwise size-grading of objects.

15. Apparatus according to claim 9 wherein said means within said inner drum comprises a linearly movable conveyor.

* * * * *